US011192752B2

(12) United States Patent
Camenzind et al.

(10) Patent No.: US 11,192,752 B2
(45) Date of Patent: Dec. 7, 2021

(54) ELEVATOR DRIVE CONTROL DURING POWER DISRUPTION

(71) Applicant: Inventio AG, Hergiswil (CH)

(72) Inventors: Roman Camenzind, Inwil (CH); Thomas Eilinger, Küssnacht am Rigi (CH); Om Prakash, Hergiswil (CH)

(73) Assignee: INVENTIO AG, Hergiswil (CH)

( * ) Notice: Subject to any disclaimer, the term of this patent is extended or adjusted under 35 U.S.C. 154(b) by 504 days.

(21) Appl. No.: 16/303,221

(22) PCT Filed: May 31, 2017

(86) PCT No.: PCT/EP2017/063144
§ 371 (c)(1),
(2) Date: Nov. 20, 2018

(87) PCT Pub. No.: WO2017/207624
PCT Pub. Date: Dec. 7, 2017

(65) Prior Publication Data

US 2019/0202663 A1 Jul. 4, 2019

(30) Foreign Application Priority Data

May 31, 2016 (EP) ..... 16172223

(51) Int. Cl.
*B66B 5/02* (2006.01)
*B66B 1/30* (2006.01)
*B66B 1/34* (2006.01)

(52) U.S. Cl.
CPC ..... *B66B 5/027* (2013.01); *B66B 1/308* (2013.01); *B66B 1/3407* (2013.01); *B66B 5/02* (2013.01)

(58) Field of Classification Search
CPC B66B 5/027; B66B 5/02; B66B 1/308; B66B 1/3407
See application file for complete search history.

(56) References Cited

U.S. PATENT DOCUMENTS

| | | | | |
|---|---|---|---|---|
| 4,478,315 | A | 10/1984 | Nomura | |
| 5,241,255 | A | 8/1993 | Oshima et al. | |
| 5,285,029 | A | 2/1994 | Araki | |
| 5,675,231 | A * | 10/1997 | Becerra | H02P 7/0094 318/801 |
| 6,439,347 | B2 * | 8/2002 | Suga | B66B 1/30 187/290 |
| 8,789,659 | B2 | 7/2014 | Agirman et al. | |
| 2011/0120810 | A1 | 5/2011 | Schroeder-Brumloop et al. | |
| 2017/0283213 | A1 * | 10/2017 | Lotfi | B66B 5/02 |
| 2018/0215582 | A1 * | 8/2018 | Lotfi | B66B 1/3423 |
| 2018/0275175 | A1 * | 9/2018 | Yang | G01R 19/30 |

* cited by examiner

*Primary Examiner* — Jeffrey Donels
(74) *Attorney, Agent, or Firm* — William J. Clemens; Shumaker, Loop & Kendrick, LLP

(57) ABSTRACT

A drive control method and system for controlling an inverter during power disruptions in the operation of an elevator drive includes the steps of predetermining whether a hoist motor of the elevator drive will be operating in a motor mode, a balanced mode or a regenerative mode on commencement of the power disruption, and controlling the inverter in accordance with the predetermined operating mode after commencement of the power disruption.

9 Claims, 6 Drawing Sheets

1 AC Power Supply
2 Elevator Car
4 Counterweight
12 Motor
20 Elevator Drive
22 Rectifier
28 Inverter
38 Resistor
50 Fan
52 Encoder

ELEVATOR DRIVE CONTROL DURING POWER DISRUPTION

FIELD

The present invention relates to elevators and, more particularly, to a drive control method and system for controlling an inverter during a power disruption.

BACKGROUND

A conventional traction elevator typically comprises a car, a counterweight and traction means such as a rope, cable or belt interconnecting the car and the counterweight. The traction means passes around and engages with a traction sheave which is rotated by a motor which in turn is driven by a drive. The motor and the traction sheave rotate concurrently to drive the traction means, and thereby the interconnected car and counterweight, along an elevator hoistway. At least one brake is employed in association with the motor or the traction sheave to stop the elevator and to keep the elevator stationary within the hoistway. An elevator controller supervises the drive and thereby movement of the elevator in response to travel requests or calls input by passengers.

Due to strict safety regulations summarized above, the force exerted by a brake is substantial, so that when a complete power failure or a disruption such as under-voltage occurs with the commercial mains power supply, the brake immediately engages to halt the movement of the elevator car with a large force.

Typically, the force developed by the brake will be sufficiently large so as to bring an elevator car travelling at 1 m/s to a full halt within 200 ms. This sharp reduction in speed will be uncomfortable and unsettling to any passenger riding in the elevator car and, in some cases, might even lead to injury of the travelling passenger. This problem is understandably further exaggerated in countries throughout the world which experience frequent power disruptions.

Conventionally, a solution to this problem has been to provide a re-chargeable battery which during a power failure or a disruption can automatically be used to provide the necessary power to both the brakes and the drive to ensure that the system can perform a rescue run, e.g. a trip at reduced speed to the next available landing. The re-chargeable battery is typically kept at maximum load condition in order to secure sufficient capacity for any emergency operation. Nevertheless, for the battery to be able to reliably drive the motor and thereby the elevator car to the next available landing, a battery having a substantial capacity is required. Such a system is described in patent publication U.S. Pat. No. 5,285,029.

In order to the battery size, patent publication US 2011/120810 proposes a method wherein the switching frequency of the drive is varied depending on the load condition of the elevator car stopped in the power outage. The defined load conditions are: balanced or slightly off-balanced condition between the car and the counterweight where it is necessary to actively move the car and the counterweight to the desired landing after the brake is lifted; or substantially off-balanced conditions between the car and the counterweight where the motor would continuously accelerate in generator mode after lifting the brake unless controlled accordingly.

However, in a power outage, the brake will still automatically engage to stop the motor and the car. This results in a sharp reduction in speed which, as outlined above, will be uncomfortable and unsettling to any passenger riding in the elevator car and, in some cases, might even lead to injury of the travelling passenger. It is only after emergency operation is initiated by activation of a brake release button or an emergency brake switch that the drive can be powered by the battery at the load-dependent switching frequency to perform a rescue run, e.g. a run at reduced speed to the next available landing.

In both prior art publications summarized above it should be noted that in order to perform the rescue run it is essential that electrical power is available to the drive from the battery which can be used by the motor to ensure that the elevator car can be moved to the next available landing.

SUMMARY

An objective of the present invention is to solve the aforementioned drawbacks by providing a drive control method and system for controlling an inverter independently of any alternative energy storage during power disruptions.

The invention provides a method of operating an elevator drive during a power disruption comprising the steps of predetermining whether a motor will be operating in motor mode, balanced mode or regenerative mode on commencement of the power disruption, and controlling an inverter in accordance with the predetermined operating mode after commencement of the power disruption.

Preferably, an energy storage is provided to ensure that the elevator brake can still be energized and thereby opened or maintained in an open state during power disruption. Only a relatively small uninterruptible power supply is required as it need only power the brake and not the drive nor the motor.

In the method it is necessary to predetermine which mode of operation the motor will be in before the power disruption so that the inverter can be controlled accordingly when the power disruption occurs.

If the motor is in motor mode at power disruption, then the inverter can be switched off with the brake remaining open so that the motor can freewheel and decelerate softy on a coast to stop under the natural deceleration of the elevator installation to which it is attached.

If the motor is in regenerative mode, then the elevator trip can continue.

If the motor is in balanced mode, where either the natural deceleration of the elevator installation would be insufficient to stop the motor quickly enough or the regenerative power would be too small, then the inverter can perform a high deceleration ramp by switching to regenerative mode.

In order to predetermine the operating mode, preferably the current delivered between the motor and the inverter is sampled. In one embodiment the sampling occurs at the beginning of an elevator trip as the brake is opened and the drive provides current to keep the motor stationary. Accordingly, the predetermination of the operating mode occurs before the elevator trip is underway. Alternatively or additionally, the current may be sampled during a constant speed phase of an elevator trip.

In either case the motor can be determined to be operating in balanced mode if the magnitude of the sampled current is less than a current threshold. If the sampled current is greater than the current threshold, the motor can be determined to be in motor mode or regenerative mode depending on the direction of travel.

When the power disruption occurs, a voltage across a DC link within the drive will naturally drop if the motor is operating in either motor mode or balanced mode. Accordingly, the method can include the step of monitoring this voltage across a DC link such that if it falls below a first undervoltage limit the inverter can be set to a regenerative switching schedule if the motor is in balanced mode or the inverter can be switched off completely if motor is in motor mode.

Subsequently the brake can be engaged if the voltage across the DC link falls below a second undervoltage limit or if the motor speed falls below a minimum threshold.

On the other hand, if the motor is in regenerative mode on the onset of a power failure the journey can continue the trip and to finally complete the trip by engaging the brakes. In an alternative the trip can continue until the voltage across the DC link reaches a second undervoltage limit and the brakes can be engaged.

Furthermore, the method may further comprise a step of inserting a brake resistor across the DC link if the voltage across the DC link rises above a third voltage threshold.

The invention additionally provides a system for operating an elevator motor during a power disruption. The system comprises an energy storage connectable to an elevator brake, and a drive delivering power from an AC power supply to an elevator motor. The drive comprises a converter to convert AC power from the power supply into DC power, an inverter to drive the motor by inverting DC power from the converter into AC power and rectify AC power produced by the motor when in generating mode into DC power, a DC link connected between the converter and the inverter, and a controller for controlling operation of the drive, wherein the controller samples a current transferred between the inverter and the motor during a journey to determine whether the motor is operating in motor mode, balanced mode or regenerative mode controlling, and on commencement of the power disruption controls the inverter in accordance with the predetermined operating mode.

Accordingly, the system predetermines which mode of operation the motor will be in before the power disruption so that the inverter can be controlled accordingly when the power disruption occurs.

Preferably, the controller keeps the brake contactor closed on commencement of the power disruption. Accordingly, the brake can be kept open or maintained in an open state even during power disruption rather than automatically engaging as in the prior art.

The controller may switch off the inverter after commencement of the power failure when the motor is operating in motor mode. In these circumstances the motor can freewheel and decelerate softy on a coast to stop under the natural deceleration of the elevator installation to which it is attached.

Alternatively, if the motor is in balanced mode the controller can change the inverter to a regenerative switching schedule after commencement of the power failure.

If the motor is in regenerative mode after commencement of the power failure, the controller can continue the journey.

Preferably, the controller may monitor a voltage across a DC link so as to open the brake contactor if the DC link voltage falls below a second undervoltage limit. Alternately, the system may further comprise an encoder to monitor the speed of the motor and wherein the controller opens the brake contactor if the speed falls below a minimum threshold.

DESCRIPTION OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION

Figure 1:
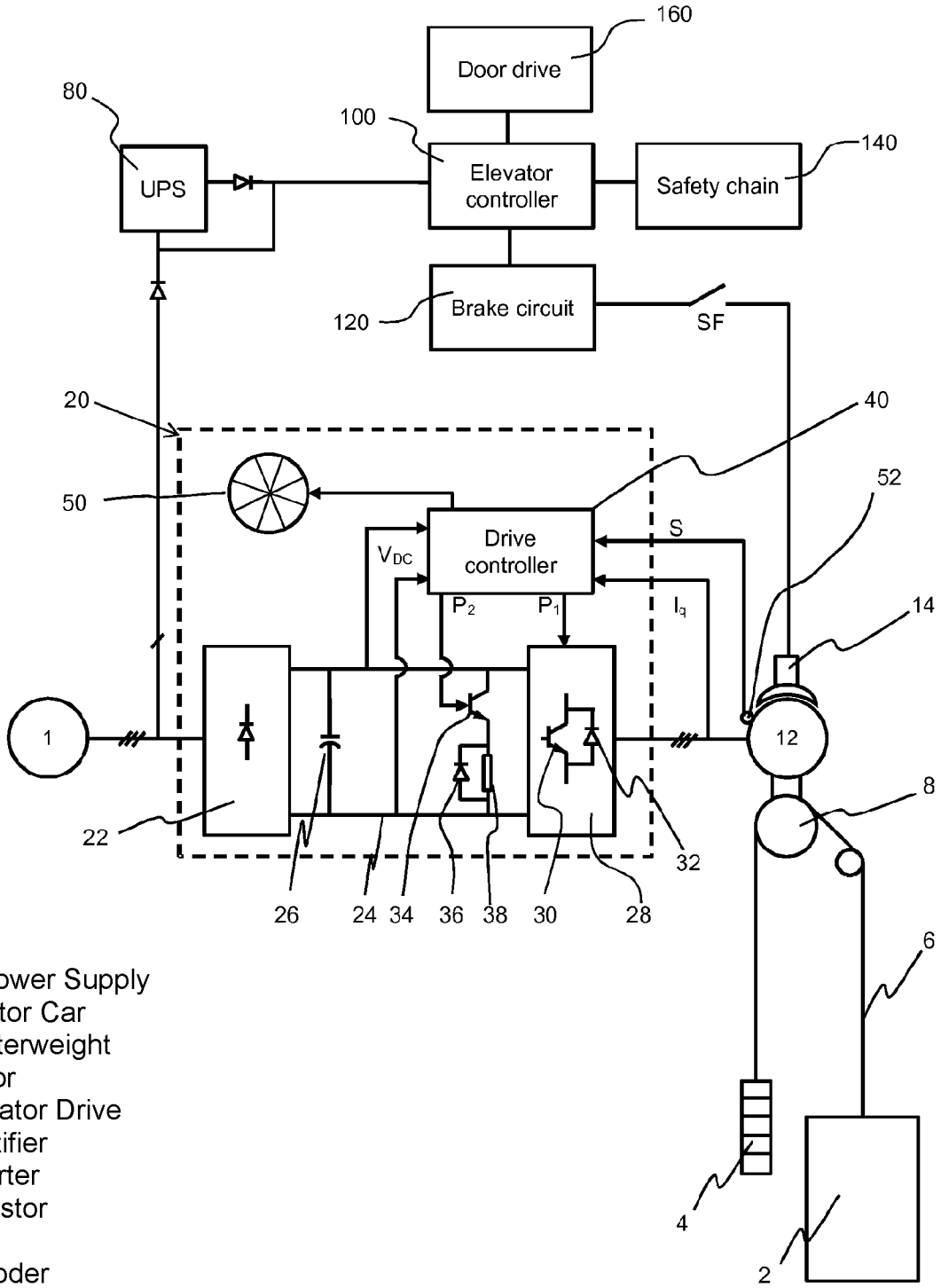
FIG. 1 is a schematic illustration of a typical elevator installation according to an embodiment of the present invention.

A conventional elevator installation for use with the method and apparatus according to the invention is shown in FIG. 1. The installation is generally defined by a hoistway bound by walls within a building wherein a counterweight 4 and car 2 are movable in opposing directions along guide rails. Suitable traction means 6, such as a rope or belt, supports and interconnects the counterweight 4 and the car 2. In the present embodiment the weight of the counterweight 4 is equal to the weight of the car 2 plus 40% of the rated load which can be accommodated within the car 2. The traction means 6 is fastened at one end to the counterweight 4, passed over a traction sheave 8 located in the upper region of the hoistway and fastened to the elevator car 2 at the other end. Naturally, the skilled person will easily appreciate that other roping arrangements are equally possible and that the counterweight balancing factor can be changed as required to meet particular specifications.

The traction sheave 8 is driven via a drive shaft by a motor 12 and braked by at least one electromagnetic elevator brake 14. Conventionally, power from the commercial mains AC power supply 1 is fed through the contacts of a main power switch in three phases via a frequency converter drive 20 to the motor 12. The elevator drive 20 includes a three phase diode-bridge rectifier 22 which converts AC line voltage into DC voltage on a DC link 24 which would typically include a capacitor 26 to smooth any ripple in the DC voltage output from the rectifier 22.

The filtered DC voltage of the DC link 24 is then input to a three phase power inverter 28 and inverted into AC voltages for the motor 12 by selective operation of a plurality of solid-state switching devices 30 within the inverter 28, such as IGBTs, which are controlled by PWM signals $P_1$ output from a drive controller 40 incorporated in the drive 20. A diode 32 is arranged in antiparallel with each of the solid-state switching devices 30 in the inverter 28.

The drive controller 40 may vary the speed and direction of the hoist motor 12 according to a reference torque current Iqref by adjusting the frequency and magnitude of the PWM signals $P_1$ to the solid-state switching devices 30 in the inverter 28 so as to appropriately adjust the actual torque current Iq supplied to the motor 12.

Additionally, if the hoist motor 12 is generating power, the drive controller 40 can deactivate the solid-state switching devices 30 in the inverter 28 to permit the torque current Iq generated to be rectified by the diodes 32 and subsequently provided to the DC link 24.

The drive 20 is typically designed to operate over a specific voltage range typically specified as a nominal operating voltage with a tolerance band. In the present embodiment, the drive controller 40 is powered by and monitors the voltage $V_{DC}$ across the DC link. If the voltage rises above an upper voltage threshold V2 (FIG. 6), as can occur when the motor 12 has been operating in regenerative mode for a prolonged period, then the drive controller 40 can issue signals $P_2$ to control a brake resistance transistor 34 arranged in series with a brake chopper across the DC link 24. The excess power can therefore be dissipated through the brake chopper which comprises a diode 36 arranged in antiparallel with a braking resistor 38. This dissipation of energy through the resistor 38 can cause unwanted or excessive heat. In that case the drive controller 40 can monitor the temperature and activate one or more fans 50 to dissipate the heat.

Overall operation of the elevator is controlled and regulated by an elevator controller 100. The elevator controller 100 receives calls placed by passengers on operating panels located on the landings of the building and, optionally, on a panel mounted within the elevator car 2. It will determine the desired elevator trip requirements and, before commencement of the trip, will instruct a brake circuit 120 to release the brakes 14, and additionally issue a travel command signal to the drive controller 40 which energizes and controls the inverter 28 as described above to allow the motor 12 to transport the passengers within the car 2 to their desired destination within the building. Movement of the motor 12, and thereby the elevator car 2, is continually monitored by an encoder 52 mounted on the traction sheave 8 or on the motor shaft. A signal S from the encoder 52 is fed back to the drive controller 40 permitting it to determine travel parameters of the car 2 such as position, speed and acceleration.

In the present example the elevator controller 100 is energized from a single phase of the commercial mains AC power supply 1. Additionally, a small uninterruptible power supply 80 is continuously charged from the mains AC power supply 1 and is connected to the elevator controller 100 such that in the event of a power failure or disruption, the uninterruptible power supply 80 can continue to maintain power to the elevator controller 100 and the brake circuit 120. In this embodiment the safety chain 140 and preferably a door drive 160 are furthermore supplied with emergency power from the uninterruptible power supply 80 via the elevator controller 100.

It is important to note that in this embodiment of the invention, the uninterruptible power supply 80 can be relatively small as it generally only has to power the internal electronics of the elevator controller 100 and the brake circuit 120. It is completely independent of the drive 20 and, in particular, is not used to feed power to the DC link 24 of drive 20 during a power disruption.

The motor 12 controls the speed and direction of movement between elevator car 2 and counterweight 4. The power required to drive the motor 12 varies with the acceleration and direction of the elevator, as well as the load in the elevator car 2. For example, the motor 12 will be operating in motor mode if the elevator is being accelerated upwards with a load greater than the weight of the counterweight 4 (i.e., heavy load), or run down with a load less than the weight of the counterweight 4 (i.e., light load). If the elevator is leveling or running at a fixed speed with a balanced load, it may be using a lesser amount of power. If the elevator is being decelerated, running down with a heavy load, or running up with a light load, the elevator drives the hoist motor 12. In this case, the hoist motor 12 generates three-phase AC power that is converted to DC power by the power inverter 28 under the control of the drive controller 40. The converted DC power is accumulated on the DC link 24.

An objective of the present invention is to predetermine whether the hoist motor 12 is being run or will be run in motor mode, balanced mode or regenerative mode before a power disruption or failure so that the inverter 28 can be effectively controlled during a power disruption or failure so as to permit a softer stop of the car 2.

Figure 2:
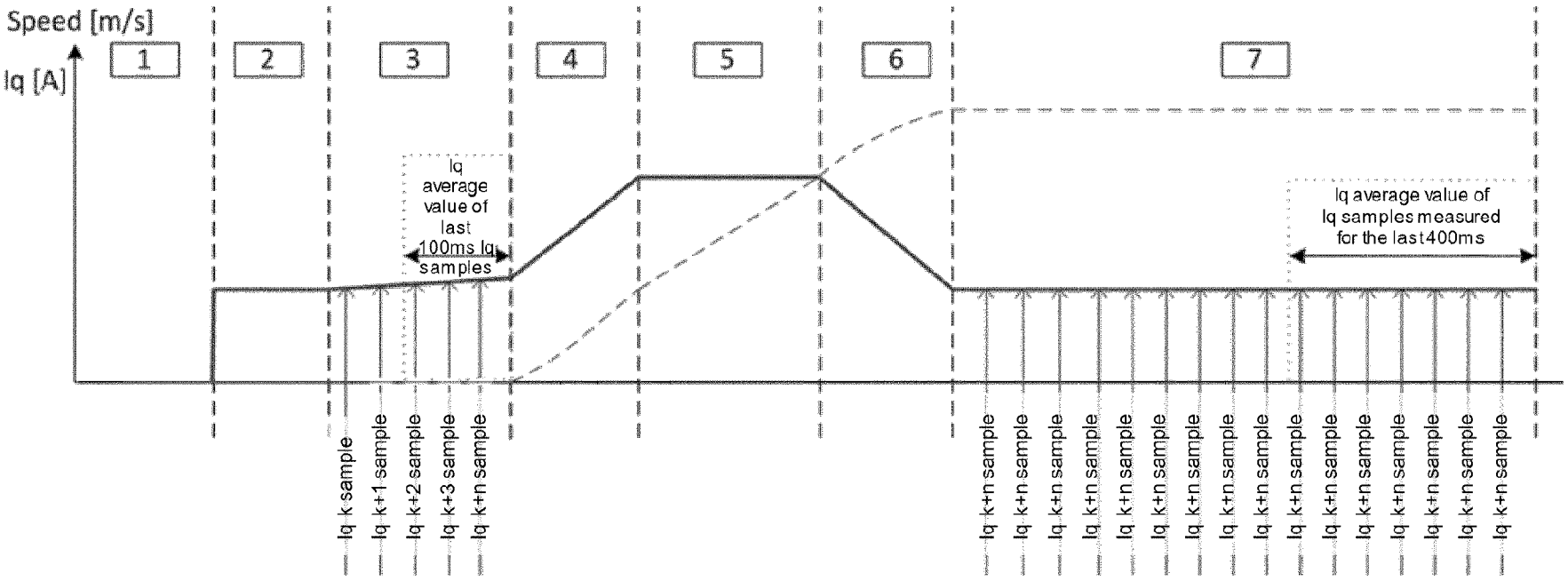
FIG. 2 is a graphical representation of the current output from the inverter of FIG. 1 as the elevator car embarks on a typical travel sequence from stationary to rated speed.

FIG. 2 is a graphical representation of the current output $I_q$ from the inverter of FIG. 1 and the speed of the elevator as the elevator car 2 embarks on a typical travel sequence from stationary to rated speed.

During phase 1 the elevator car 2 is held stationary at the landing when the brakes 14 are applied as brake contactor SF (FIG. 1) is in its normally-open state. At the beginning of phase 2, the drive 20 has received a trip command from the elevator controller 100 and prepares for the trip by delivering current $I_q$ to pretorque the motor 12. At that stage the brake contactor SF remains in the open state.

In phase 3 the drive 20 receives a signal to open the brakes 52 and the brake contactor SF is closed so as to energize the electromagnetic brakes 14. During this phase the drive 20 provides current $I_q$ to the motor 12 to keep the elevator car 2 stationary. Additionally, the drive controller 40 periodically measures the torque current $I_q$ during each cycle. The average torque current value Iqav1 is calculated from the samples taken during the last 100 ms of this phase and recorded.

In phase 4, the drive torque current $I_q$ is increased to accelerate the elevator car 2.

During phase 5 the car 2 is at rated acceleration and the torque current $I_q$ remains constant.

At phase 6, the drive recognizes that the car 2 is approaching rated speed and the torque current $I_q$ is reduced to effect a decrease in acceleration.

After reaching the constant speed trip phase in phase 7, the drive 40 periodically measures the torque current $I_q$ for each cycle. The average torque current value Iqav2 is calculated from the samples taken during the last 400 ms of this phase and recorded.

Figure 3:
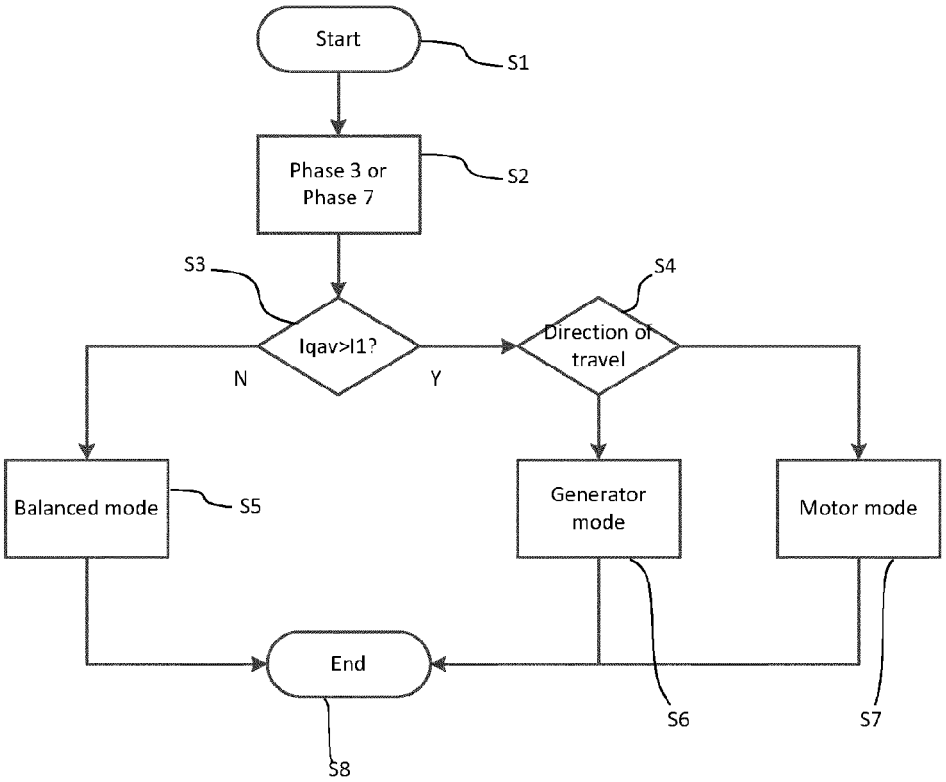
FIG. 3 is a flowchart illustrating the method steps performed by the drive controller of FIGS. 1 and 2 to determine whether the hoist machine is or will be operating in balanced mode, regenerative mode or motor mode for a given trip.

From the recorded average torque current values Iqav1 or Iqav2 and from the direction of travel the drive controller 40 can determine whether the hoist machine 12 is or will be operating in balanced mode, regenerative mode or motor mode for a given trip using the steps outlined in the flowchart of FIG. 3.

The procedure starts as step S1 and the drive 20 commences the trip phases explained above with reference to FIG. 2. At step S2 the average torque current value Iqav recorded in phase 3 or phase 7 is retrieved and compared with a preset current value 11 in step S3. If the average torque current value Iqav is less than the preset current value 11, the motor 12 is determined to be in balanced mode step S5. In the alternative, if the average torque current value Iqav is greater than the preset current value 11, then the motor 12 is determined to be operating in either motor or regenerative mode. In this case the controller 40 further determines in step S4 from the direction of travel as provided by the encoder 52 whether the motor 12 is operating in regenerative mode step S6 or in motor mode step S7. Once the mode of operation is determined, the procedure ends in step S8.

Figure 4:
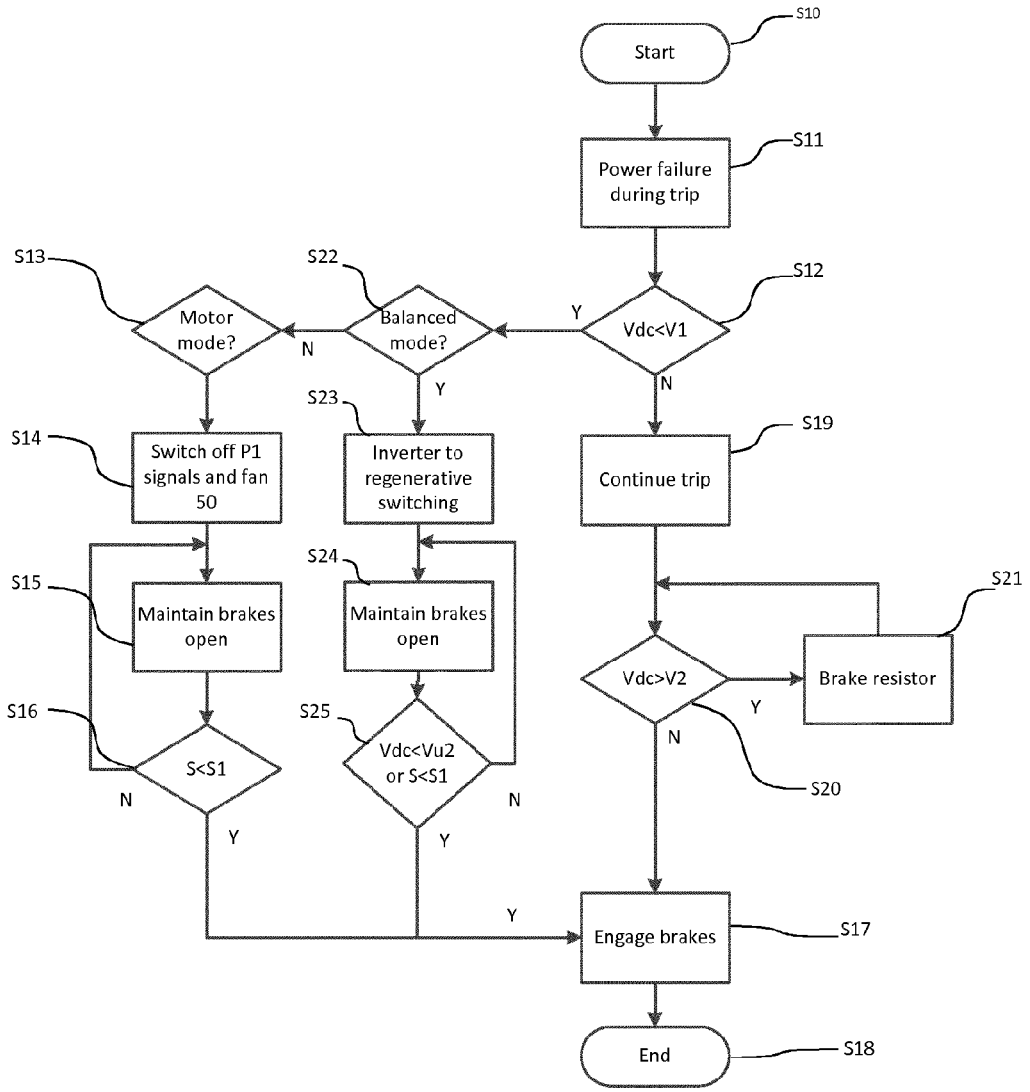
FIG. 4 is a flowchart illustrating the method steps performed by the drive controller of FIGS. 1 and 2 leading up to and subsequent to a power disruption.

Having determined the mode of operation as outlined above, the drive controller 40 can be configured to implement the method steps illustrated in FIG. 4 in the event of a power disruption during a normal elevator trip. For the purpose of illustration the flowchart will be used in the following description together with the graphical representation of FIG. 5 to illustrate the steps taken upon power failure in motor mode, FIG. 6 for power failure in regenerative mode and FIG. 7 for power failure in balanced mode, respectively.

Figure 5:
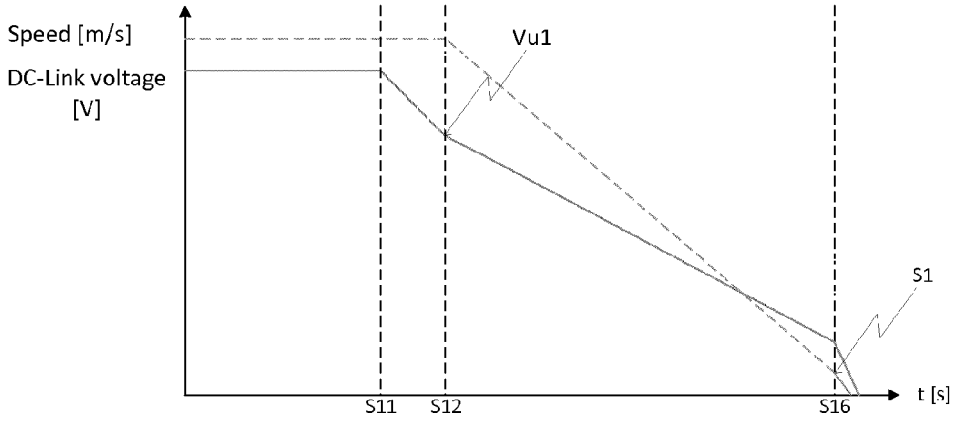
FIG. 5 is a graphical representation of the DC link voltage and car speed if the hoist machine is operating in motor mode during power failure.

Motor Mode FIG. 5

The normal elevator trip is commenced in step S10 and the motor mode of operation has already been determined by the drive controller 40 as previous described. As shown by the dashed line in FIG. 5, the motor 14 has already reached constant, rated speed when a disruption or failure occurs to the commercial mains AC power supply at step S11. The voltage of the DC link 24, shown by the solid line in FIG. 5, immediately starts to decrease because it is still being used to feed power to the drive controller 40, the inverter 28, the encoder 52 and to the fans 50. Once the drive controller 40 observes that the voltage $V_{DC}$ across the DC link 24 has reduced to a first undervoltage limit Vu1 at step S12, the controller 40 knowing that it is driving the motor 12 in motor mode at step S13 switches off the PWM signals $P_1$ to the inverter 28 and de-energizes the fans 50 at step S14. Accordingly, only internal electronics of the controller 40 and the encoder 52 are supplied from the DC link 24 and accordingly the rate of decline of the voltage $V_{DC}$ across the DC link 24 is significantly reduced. Simultaneously at step S15, the controller 40 keeps the brakes 14 open by keeping the brake contactor SF closed so that the brake circuit 120 can continue to energize the brakes 14 from the small uninterruptible UPS 80 shown in FIG. 1.

Subsequent to step S12, the motor 12 is freewheeling and therefore the elevator car 2 can decelerate gently due to the natural deceleration of the installation until at step S16 when the speed S registered by the encoder 52 reaches a minimum threshold S1 when the drive controller 40 executes an emergency stop by opening the brake contactor SF in the brake circuit and thereby engaging the brakes 14.

Figure 6:
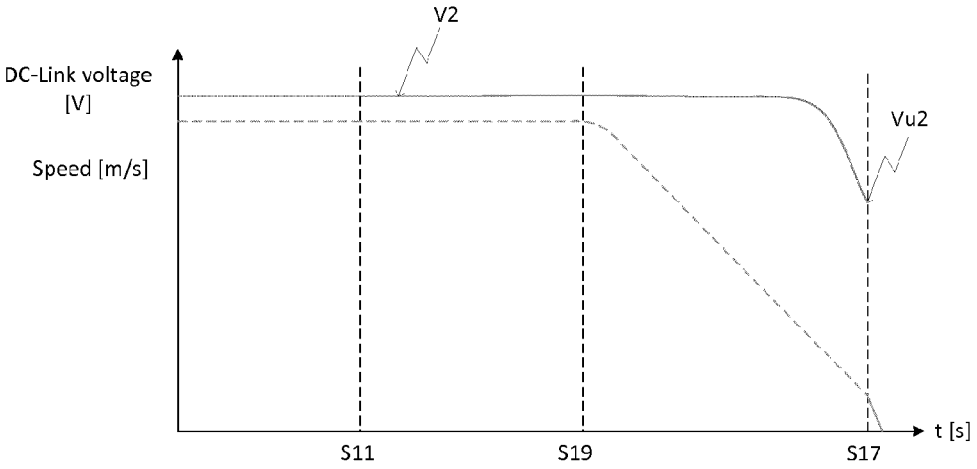
FIG. 6 is a graphical representation of the DC link voltage and car speed if the hoist machine is operating in balanced mode during power failure.

Regenerative Mode FIG. 6

Again the normal elevator trip is commenced in step S10 and the regenerative mode of operation has already been determined by the drive controller 40 as previously described. As show by the dashed line in FIG. 6, the motor 14 has already reached constant, rated speed when a disruption or failure occurs to the commercial mains AC power supply at step S11. In this regenerative case it is possible that the energy regenerated by the motor 12 to the DC link 24 will be sufficient to enable the drive controller 40 to continue the trip in step S19 and to finally complete the trip in step S17 by opening brake contactor SF and thereby applying the brakes 14 when the elevator car 2 has reached a landing. During this procedure the drive controller 40 monitors the voltage $V_{DC}$ across the DC link such that if it rises above the upper voltage threshold V2 at step S20 it can issue signals $P_2$ to control the brake resistance transistor 34 in step S21 to dissipate excess energy in the DC link 24 through the brake resistor 38.

In an alternative depicted in FIG. 6, if the drive controller 40 is unable complete the trip, it will continue the trip as in step S19 until the voltage $V_{DC}$ across the DC link reaches a second undervoltage limit Vu2 at which point it will immediately engage the brakes 14 by opening the contactor SF in the brake circuit as at step S17.

Figure 7:
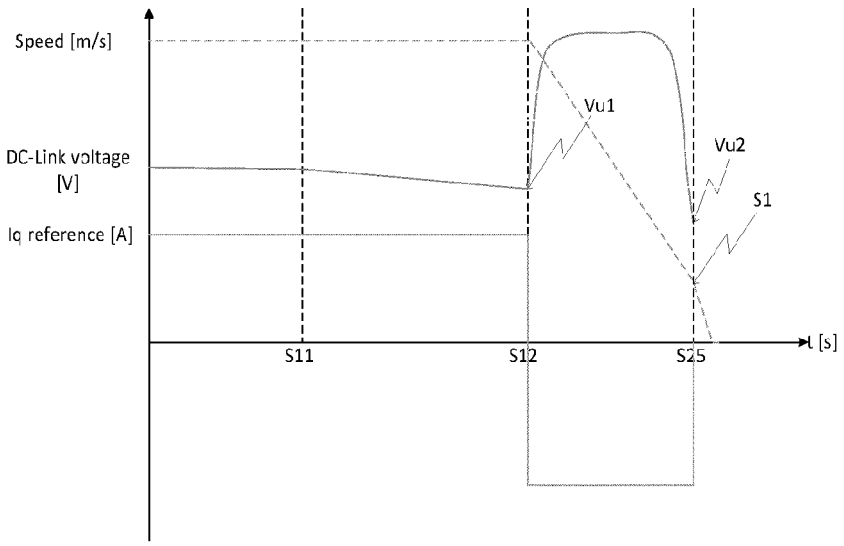
FIG. 7 is a graphical representation of the DC link voltage, car speed and reference torque current if the hoist machine is operating in regenerative mode during power failure.

Balanced Mode FIG. 7

The normal elevator trip is commenced in step S10 and the balanced mode of operation has already been determined by the drive controller 40 as previously described. As shown by the dashed line in FIG. 7, the motor 14 has already reached constant, rated speed when a disruption or failure occurs to the commercial mains AC power supply 1 at step S11.

As shown in this example, the torque current reference value Iqref, from which the drive controller 40 determines the appropriate frequency and magnitude of the PWM signals $P_1$ to send to the inverter 28, is set to such that although the motor 12 is in balanced mode it is still drawing power from the DC link 24 via the inverter 28 before and immediately after power disruption at step S11.

The voltage $V_{DC}$ of the DC link 24, shown by the solid line in FIG. 5, immediately starts to decrease after step S11 because it is still being used to feed power to the drive controller 40, the inverter 28, the encoder 52 and to the fans 50. In this example, however, it should be noted that the rate of decrease in the voltage $V_{DC}$ is appreciably less than was the case in motor mode as illustrated in FIG. 5, this is due to the fact that less power is drawn by the inverter 28 from the DC link 24 to drive the motor 12.

Once the drive controller 40 observes that the voltage $V_{DC}$ across the DC link 24 has reduced to the first undervoltage limit Vu1 at step S12, the controller 40 knowing that it is in balanced mode at step S22 immediately performs a high deceleration ramp by setting the torque current reference value Iqref to a maximum regenerative value and provides the appropriate PWM switching signals $P_1$ to the inverter 28 at step S23. Accordingly, the voltage $V_{DC}$ across the DC link 24 will rise considerably as shown but consequentially the speed S will decrease at a steep rate from step S12. Simultaneously at step S24, the controller 40 keeps the brakes 14 open by keeping the brake contactor SF closed so that the brake circuit 120 can continue to energize the brakes 14 from the small uninterruptible UPS 80 shown in FIG. 1.

Subsequent to step S12, the elevator car 2 decelerates until at step S25 when either the speed S registered by the encoder 52 reaches a minimum threshold S1 or when the voltage $V_{DC}$ across the DC link 24 reaches the second undervoltage limit Vu2 the controller 40 will immediately engage the brake 14 by opening the contactor SF in the brake circuit as at step S17. The elevator trip is ended in a step S18.

The foregoing is a description of preferred examples of the present invention and the person skilled in the art would naturally appreciate that the method and system outlined above can be modified in arrangement and detail without departing from the principles and objectives of the present invention.

For example, although an uninterruptible power supply UPS is described in the preceding embodiments, it is easily conceivable to the skilled person that any energy storage 80 can be used to provide the necessary power to the brake circuit 120 and optionally the elevator controller 100, safety chain 140 and door drive 160 during mains power disruption. The energy storage 80 could be in the form of a simple, commercially available battery or battery bank which in turn could be completely independent from the mains power supply 1 or could be charged via a battery charger from the mains power supply 1.

Furthermore, in the preferred embodiments it is envisaged that the method would be implemented by software on an existing drive 20 without the necessity of modifying or changing the associated hardware. In particular, it should be noted that the entire drive 20 is provided independently of the energy storage 80. However, the hardware of the system could be modified slightly so that the energy storage 80 additionally powers the drive controller 40 and associated encoder 52 during power disruption without a significant increase in capacity, size or cost of the energy storage 80. The most significant power demand from the drive 20 is that required to drive the motor 12. However, since this does not occur using the method steps outlined above, the power required by the drive 20 for the controller 40 and encoder 52 during power disruption should be minimal. The only restriction is that the energy store should not be used to power the DC link 24 directly or indirectly.

Instead of providing a passive diode-bridge rectifier as the converter 22, it will be readily appreciated an active line converter can be implemented within the drive 20. In that case, the driver controller 40 would not only control the inverter 28 but could also be programmed to control the active line converter so that excess energy regenerated by the motor 12 when in regenerative mode could to be fed back to the commercial mains AC power supply 1 rather than being dissipated as heat by the brake resistor 38. In some instances it may be possible to discard the brake resistance transistor 34 and brake chopper completely.

Another illustration of how the method and system could be modified is to replicate the inverter control technique used in balanced mode after commencement of the power failure for motor mode also instead of switching off the inverter.

These are just a few limited examples but other modifications would be easily appreciable to the person skilled in the art.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of operating an elevator drive to move an elevator car during a disruption of a mains power supply independently of any alternative energy storage for feeding power to the drive, comprising the steps of:

predetermining, by sampling a current delivered between a hoist motor and an inverter of the drive, whether the hoist motor will be operating in a balanced mode, in which balanced mode a magnitude of the sampled current is less than a predetermined current threshold, or in a motor mode or a regenerative mode, in which motor and regenerative modes the magnitude of the sampled current is greater than the predetermined current threshold, on commencement of the power disruption;

controlling the inverter in accordance with the predetermined hoist motor operating mode independently of the alternative energy storage after the commencement of the power disruption;

wherein the operating mode of the hoist motor is predetermined by sampling the current at a beginning of an elevator trip of the elevator car as an associated brake is opened and the drive provides the current to keep the motor stationary, or by sampling the current during a constant speed phase of the elevator trip of the elevator car; and switching off the inverter after the commencement of the power disruption if the hoist motor is in the motor mode, or changing the inverter to a regenerative switching schedule after commencement of the power disruption if the hoist motor is in the balanced mode.

2. The method according to claim 1 wherein the motor is predetermined to be in the motor mode or the regenerative mode depending on a direction of travel of the elevator car.

3. A system for operating an elevator hoist motor to move an elevator car during a power disruption comprising:

an energy storage connectable to an elevator brake for the elevator car; and a drive delivering power from an AC power supply to an elevator hoist motor, wherein the drive comprises a converter for converting AC power from the power supply into DC power, an inverter for driving the hoist motor by inverting the DC power from the converter into AC power and for rectifying AC power produced by the hoist motor when the hoist motor is in a generating mode into DC power, a DC link connected between the converter and the inverter and being independent from the energy storage, and a controller for controlling operation of the drive, wherein the controller samples a current transferred between the inverter and the hoist motor during a trip of the elevator car to determine whether the hoist motor is operating in a motor mode, a balanced mode or a regenerative mode, and after commencement of a power disruption controls the inverter in accordance with the determined operating mode and keeps the brake connected to the energy storage on the commencement of the power disruption.

4. The system according to claim 3 wherein the controller switches off the inverter after the commencement of the power failure if the hoist motor is in the motor mode.

5. The system according to claim 3 wherein the controller changes the inverter to a regenerative switching schedule after the commencement of the power failure if the hoist motor is in the balanced mode.

6. The system according to claim 3 wherein after the commencement of the power disruption the controller switches off the inverter if the hoist motor is in the motor mode or changes the inverter to a regenerative switching schedule if the hoist motor is in the balanced mode.

7. A method of operating an elevator drive to move an elevator car during a disruption of a mains power supply independently of any alternative energy storage for feeding power to the drive, comprising the steps of:

predetermining, by sampling a current delivered between a hoist motor and an inverter of the drive, whether the hoist motor will be operating in a balanced mode, in which balanced mode a magnitude of the sampled current is less than a predetermined current threshold, or in a motor mode or a regenerative mode, in which motor and regenerative modes the magnitude of the sampled current is greater than the predetermined current threshold, on commencement of the power disruption;

controlling the inverter in accordance with the predetermined hoist motor operating mode independently of the alternative energy storage after the commencement of the power disruption; and wherein the sampling of the current is performed at a beginning of an elevator trip of the elevator car as an associated elevator brake is opened and the drive is providing the current to keep the motor stationary, or the sampling of the current is performed during a constant speed phase of an elevator trip of the elevator car.

8. The method according to claim 7 including a step of changing the inverter to a regenerative switching schedule when the hoist motor is in the balanced mode after the commencement of the power disruption.

9. The method according to claim 7 including a step of switching off the inverter when the hoist motor is in the motor mode after the commencement of the power disruption.

* * * * *